United States Patent [19]

Ikeda et al.

[11] 4,290,857

[45] Sep. 22, 1981

[54] METHOD OF FORMING FINE BORE

[75] Inventors: Kunio Ikeda; Hirosi Haga, both of Tokyo, Japan

[73] Assignee: Ricoh Co., Ltd., Tokyo, Japan

[21] Appl. No.: 147,131

[22] Filed: May 6, 1980

[30] Foreign Application Priority Data

May 30, 1979 [JP] Japan ..... 54/67067

[51] Int. Cl.[3] ..... C25D 1/02; C25D 1/08

[52] U.S. Cl. ..... 204/9; 204/11

[58] Field of Search ..... 204/9, 11

[56] References Cited

U.S. PATENT DOCUMENTS 3,167,489 1/1965 Hadjian ..... 204/11
3,329,588 7/1967 Mears ..... 204/9
3,461,045 8/1969 Franks ..... 204/11
3,607,674 9/1971 Lauritzen ..... 204/9
3,704,175 11/1972 MacKinney ..... 204/9

*Primary Examiner*—T. M. Tufariello
*Attorney, Agent, or Firm*—Oblon, Fisher, Spivak, McClelland & Maier

[57] ABSTRACT

A method of forming a fine bore having the steps of effecting electro-forming on a core wire to form an electro-cast rod, slicing the electro-cast rod by forming chips each having the core wire and removing the core wire to thereby form in each chip a fine bore of a diameter coinciding with the diameter of the core wire and having a high circularity and cylindricalness. Since the fine bore is constituted by an electro-formed layer, the bore exhibits high wear resistance and, hence, a high durability when used as nozzle bore of an ink jet plotter.

10 Claims, 11 Drawing Figures

METHOD OF FORMING FINE BORE

BACKGROUND OF THE INVENTION

1. Field of the Invention

The present invention relates to a method of forming a fine bore suitable for use in the production of a head for an ink jet plotter and the like.

2. Description of the Prior Art

The nozzle bore formed in the head of ink jet plotter usually has a diameter of about 30μ or so. Various methods have been taken for forming such fine bores, such as photo-etching, electro-forming, mechanical processing, laser beam, electronic beam and so forth. Referring first to the photo-etching method, the formed bore inconveniently has a conical shape or the bore is spread at both its ends. In addition, it is not possible to obtain a sufficiently high linearity at the side surface of the bore. Due to the problem concerning this side edge, the kind of material and the plate thickness are impractically limited for achieving sufficiently high precision work.

The electro-forming also cannot provide a sufficiently high cylindricalness because of melting of material at both ends of the bore, and cannot permit easy formation of a fine bore with high precision.

In the case of mechanical processing, the fine bore is formed by means of a micro-drill or like tool. In this case, however, the yield rate is impractically low and the bore is liable to be tapered due to eccentricity or offset of the tool. In addition, the drill, which is expensive, is worn out rapidly. Further, the mechanical processing with a drill necessitates an additional step of removal of burr.

The method making use of a laser beam or electron beam has a drawback in that the initial cost is impractically high and that the secondary work such as removal of thermally-affected layer and shaping of the bore is essential, and cannot provide for easy formation of the bore.

For these reasons, it has been proposed and attempted to form a fine bore by surrounding a core wire with a metal, embedding the metal and the core wire as a unit in a plastic and finally removing the core wire by melting, dissolving or by an electrolytic process, thereby forming a bore of the same diameter as the core wire. In such a case, since the matrix material is a plastic which has little durability, it is necessary to remove only the core wire, leaving the metallic layer formed on the core wire. As a result, the whole process is inconveniently complicated and the step of removal of the core wire has to be made under various restrictions. The removal of the core wire by a chemical process is usually accompanied with production of noxious substances, requiring countermeasures for the treatment of effluent or waste water.

SUMMARY OF THE INVENTION

It is, therefore, a first object of the invention to provide a method which permits easy formation of a bore at a high circulatory and cylindricalness.

It is a second object of the invention to provide a method of forming a fine bore which exhibits high wear resistance when used for an injection of liquid.

It is a third object of the invention to provide a method which permits easy production of a mutli-nozzle head.

Other objects of the invention will become clear from the following description of the preferred embodiments taken in conjunction with the accompanying drawings.

DETAILED DESCRIPTION OF THE PREFERRED EMBODIMENTS

Figure 1:
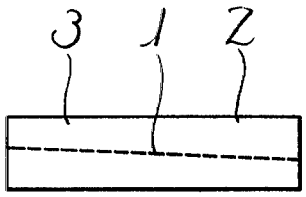
FIG. 1 is a side elevational view of an electrocast rod.
Figure 2:
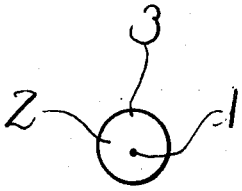
FIG. 2 is a front elevational view of the electrocast rod.
Figure 3:
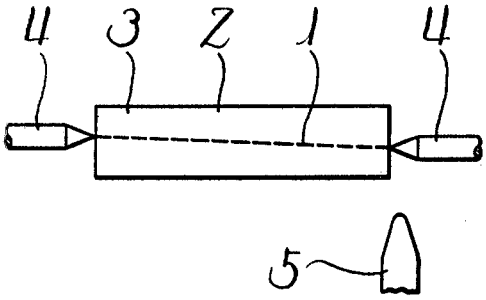
FIG. 3 is a side elevational view of the electrocast rod during the state of processing of the outer periphery thereof.
Figure 4:
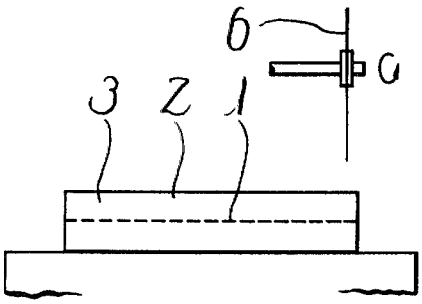
FIG. 4 is a side elevational view of the electrocast rod during the state of cutting.
Figure 5:
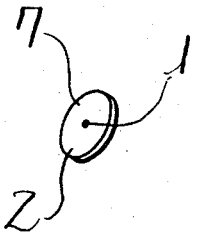
FIG. 5 is a perspective view of a tip.
Figure 6:
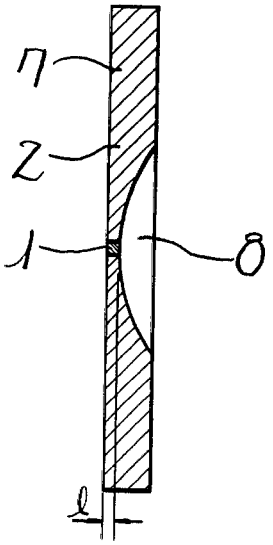
FIG. 6 is an enlarged sectional view of a tip.
Figure 7:
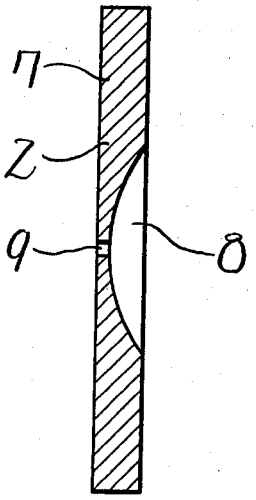
FIG. 7 is an enlarged sectional view of the electrocast rod after removal of a wire.
Figure 8:
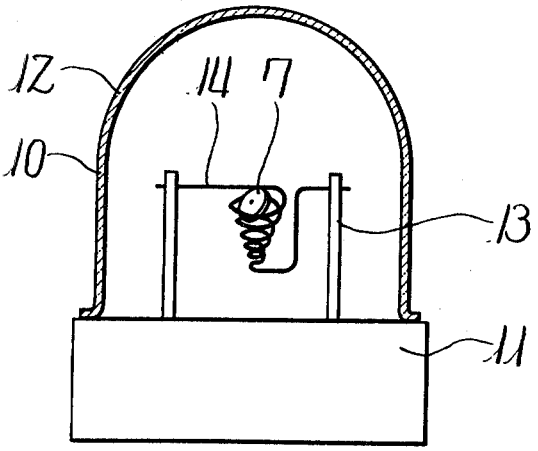
FIG. 8 is a side elevational view of an example of a mechanism for removing the wire.

Hereinafter, a first embodiment of the invention will be described with reference to the accompanying drawings. A wire 1 having a diameter of 30μ is prepared for forming a fine bore of 30μ diameter. Various materials can be used as the material of this wire 1. For instance, the wire 1 may be made of copper.

The wire 1 is stretched linearly on a jig for electroforming and electro-forming is effected to form an electro-forming layer 2 of a considerable thickness around the wire 1. The electro-forming bath can be formed of various materials. For instance, nickel sulfamine bath, Watt bath, nickel fluoride boride bath and total nickel chloride bath are known. In the described embodiment, the electro-forming was conducted with nickel sulfamine bath which was composed of 400 g/l of nickel sulfamine, 10 g/l of nickel chloride, 40 g/l of boric acid and surface active agent for prevention of pit. The casting was conducted under liquid temperature of 40°-60° C., PH value of 3.5 to 4.5 and current density of 2.5 to 20 A/dm$^2$. An electro-formed rod 3 having an electrocast layer 2 of nickel around a copper core wire 1 is formed as a result of this electro-forming. In this electro-formed rod, the core wire 1 is not always located at the center of the core wire 1. If the outer peripheral surface of the rod around the core wire 1 is deviated from the desired size, turning or grinding is effected with a spindle 4 centered at the core wire 1 at both ends of the electro-formed rod 3, by means of a turning or grinding tool 5, so that the outer periphery of the rod 3 becomes exactly concentric with the core wire 1.

The electro-formed rod after the turning is then sliced into disc shaped chips 7 of 0.2 mm thick, by means of a cutting blade 6. Thus, a multiplicity of chips 7 are formed from a single electro-formed rod 3. A spherical recess 8 is formed by grinding of one surface of each chip 7. This spherical recess 8 is essential when the chip is used as the material of a head of ink jet plotter. Therefore, the recess 8 is not formed if the chip 7 is used for other purposes. The radius of curvature of this recess is 0.7 R, and the thickness l of the chip at the portion where the core wire 1 remains is 0.03 mm.

The chip 7 is then placed in warm solution of 10% sodium cyanide, so as to dissolve and remove the core wire 1 made of copper, to thereby form a fine bore 9. The temperature of solution is 30° to 40° C. The core wire 1 can be completely removed if the dissolution is conducted under assistance of ultrasonic wave. The shape of the fine bore 9 thus formed is strictly identical to that of the core wire 1. Namely, the fine bore 9 is formed at a high dimensional precision to have a desirable circularity and cylindricalness.

It is an effective measure to use a belljar 10 in the removal of the core wire 1. More specifically, a cover 12 is placed in an airtight manner on a body 11 provided with a vacuum evacuation system and an electric heat source. A tungsten heater 14 supported by a pillar 13 is mounted in the cover 12. The chip 7 is placed on the tungsten heater 14 and is heated under the vacuum of $10^{-5}$ Torr. Since the melting point of the core wire 1 is about 500° C. lower than that of the electro-cast layer 2, the material of the core wire 1 is evaporated and removed. In this case, however, it is necessary to control the time length for energization of the heater 14 in order to prevent the evaporation of the electro-cast layer 2. The generation of noxious component is avoided in this process for removing the core wire.

Figure 9:
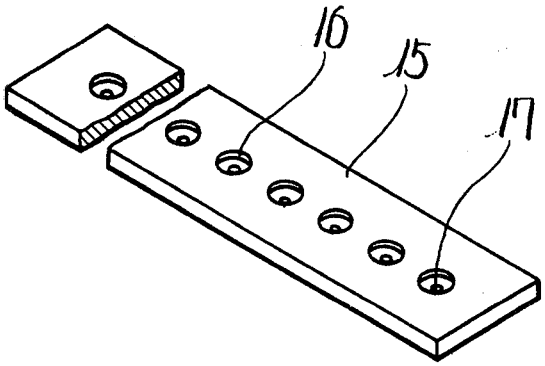
FIG. 9 is a perspective view of a substrate for forming a multi-nozzle head.
Figure 10:
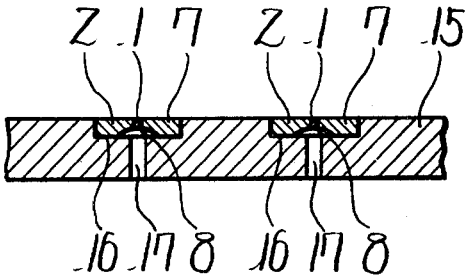
FIG. 10 is an enlarged sectional view of a substrate to which a tip is formed.
Figure 11:
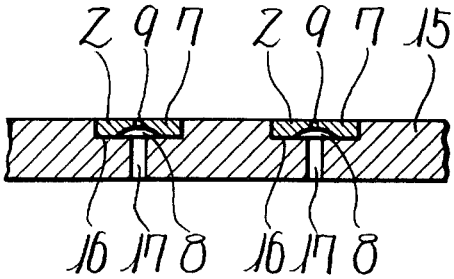
FIG. 11 is an enlarged sectional view of the substrate from which wires have been removed.

A second embodiment of the invention will be described hereinunder with specific reference to FIGS. 9 to 11. This embodiment is utilized for obtaining a multi-nozzle head.

A flat substrate 15 is formed from a stainless steel plate or the like. A plurality of recesses 16 having a diameter of 2 mm and a depth of 0.2 mm are formed in one surface of the substrate 15 at a required pitch. Through bores 17 are formed at the centers of the recesses 16. The aforementioned chip 7 is fitted to each recess 16 of the substrate 15 and is fixed to the latter by bonding or a welding by means of laser beam, with the aforementioned spherical recess placed inside. The bonding is made preferably by means of an adhesive of the epoxy resin group.

The substrate 15, to which the chips 7 are fixed is dipped in the warm solution of sodium cyanide of 40°-50° C. and the core wires 1 are removed under the assistance of ultrasonic wave. As a result, a plurality of fine bores 9 each having the same shape and size as the core wire 1 is formed. The fine bores 9 thus formed are arrayed at a pitch which is determined by the mechanical processing for forming the recesses 16 in the substrate 15. Thus, the precision of the pitch of the fine bores 9 can be enhanced by increasing the precision of the mechanical processing.

Hereinafter, description will be made as to another process for forming the multi-nozzle head. The substrate 15 is formed beforehand as in the embodiment described before. In this case, however, the core wire 1 is removed from each chip 7 before the latter is fixed to the substrate. The removal of the core wire 1 is made by dipping the chip 7 in a warm solution of sodium cyanide of 40°-50° C., under the assistance of ultrasonic wave. The chip 7 in which the fine bore 9 is formed by the removal of the core wire 1 is fitted to each recess 16 of the substrate and bonded or welded to the latter as in the preceding embodiment. The substrate 15 having chips 7 fixed thereto is used as a multi-nozzle head and is completed as an ink jet plotter upon being connected to an ink supplying section. In this multi-nozzle head, the nozzle bores constituted by the fine bores 9 have uniform diameter, circularity, cylindricalness and coaxiality because they conform the shape of the core wires 1, and, accordingly, exhibit uniform ink jetting characteristic.

The method of the invention heretofore described makes it possible to form nozzle bores of diameters down to 20$\mu$.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of forming a fine bore ink head comprising the steps of:

effecting electro-forming on a core wire having the same diameter as that of a fine bore to be formed to form an electro-formed layer around said core wire to thereby make an electro-formed rod having said core wire at its center;

slicing said electroformed rod to form a plurality of disc-shaped chips containing said core wire; and removing said core wire by dissolution or heating to thereby form in said chips a fine bore of the same diameter as said core wire and to form said ink head.

2. A method of forming a fine bore ink head as claimed in claim 1, wherein said electro-formed layer is formed of a material having a melting point higher than that of said core wire, and that said removing said core wire comprises heating said core wire in a vacuum atmosphere.

3. A method of forming fine bore of a multi-nozzle ink head comprising the steps of:

effecting electro-forming on a core wire having the same diameter as that of fine bores to be formed to form an electro-formed layer around said core wire to thereby make an electro-formed rod having said core wire at its center;

slicing said electro-formed rod to form a plurality of chips containing said core wire;

forming a fine bore of the same diameter as said core wire in each chip by removing said core wire by dissolution or heating; and fixing said chips to a substrate to form said multi-nozzle ink head.

4. A method of forming fine bores of a multi-nozzle ink head comprising:

effecting electro-forming on a core wire having the same diameter as that of fine bores to be formed so as to form an electroformed layer around said core wire to thereby make an electro-formed rod having said core wire at its center;

slicing said electro-formed rod to form a plurality of chips containing said core wire;

fixing said chips to a substrate; and removing said core wire of each chip by dissolution or heating thereby to form a plurality of fine bores of said multi-nozzle head and to form said multi-nozzle ink head.

5. A method of forming a fine bore as set forth in claims 1, 2, 3 or 4, which further comprising grinding a spherical recess in each of said chips.

6. A method of forming a fine bore as set forth in claim 5, wherein said grinding step further comprises grinding a spherical recess having a radius of curvature of 0.7 R such that the thickness of each of said plurality of chips at a portion where the core wire remains before removal is 0.03 mm.

7. A method of forming a fine bore as set forth in claims 1, 2, 3 or 4 which further comprises:

centering spindle means at said core wire on opposite ends of said electro-formed rod;

turning said core wire about said spindle means; and grinding the outer peripheral surface of said core wire such that a resulting outer periphery becomes concentric with said core wire.

8. A method of forming a fine bore as set forth in claims 1, 2, 3 or 4 wherein the chips are 0.2 mm thick.

9. A method of forming a fine bore as set forth in claims 1, 2, 3 or 4 wherein the core wire has a diameter of 30μ.

10. A method of forming a fine bore as set forth in claims 1, 2, 3 or 4 wherein the chips are 0.2 mm thick and wherein the core wire has a diameter of 30μ.

* * * * *